United States Patent [19]

Staudenmayer et al.

[11] Patent Number: 4,578,333

[45] Date of Patent: Mar. 25, 1986

[54] MULTILAYER PHOTOCONDUCTIVE ELEMENTS HAVING AN ACRYLONITRILE COPOLYMER INTERLAYER

[75] Inventors: William J. Staudenmayer, Pittsford; Tsang J. Chen, Rochester; Paul M. Borsenberger, Hilton; Hans R. Grashof, Rochester, all of N.Y.

[73] Assignee: Eastman Kodak Company, Rochester, N.Y.

[21] Appl. No.: 643,768

[22] Filed: Aug. 24, 1984

Related U.S. Application Data

[63] Continuation of Ser. No. 495,227, May 16, 1983, abandoned.

[51] Int. Cl.[4] ..... G03G 5/14

[52] U.S. Cl. ..... 430/60; 430/58

[58] Field of Search ..... 430/62, 63, 64, 66, 430/58, 60

[56] References Cited

U.S. PATENT DOCUMENTS

| | | | |
|---|---|---|---|
| 3,904,407 | 9/1975 | Regensburger et al. | 96/1.5 |
| 4,082,551 | 4/1978 | Stiklinski et al. | 96/1 |
| 4,116,894 | 9/1978 | Lentz et al. | 430/56 |
| 4,173,473 | 11/1979 | Petropoulos et al. | 430/72 |
| 4,175,960 | 11/1979 | Berwick et al. | 430/64 |
| 4,248,952 | 2/1981 | Paulin et al. | 430/62 |

*Primary Examiner*—John L. Goodrow

*Attorney, Agent, or Firm*—Alfred P. Lorenzo

[57] ABSTRACT

In photoconductive elements having a conductive support, a charge generation layer containing a photoconductive pigment such as a perylene compound and a charge transport layer, an acrylonitrile copolymer interlayer is disposed between the charge generating layer and the support. This interlayer provides the element with improved adhesion and increased photosensitivity.

18 Claims, No Drawings

MULTILAYER PHOTOCONDUCTIVE ELEMENTS HAVING AN ACRYLONITRILE COPOLYMER INTERLAYER

This is a continuation of application Ser. No. 495,227, filed May 16, 1983 now abandoned.

This invention relates to multilayer photoconductive elements and more particularly to such elements containing photoconductive pigments such as, for example, perylene compounds.

Photoconductive elements comprise a conducting support bearing a layer of a photoconductive material which is insulating in the dark but which becomes conductive upon exposure to actinic radiation. A common technique for forming images with such elements is to uniformly electrostatically charge the surface of the element and then imagewise expose it to actinic radiation. In areas where the photoconductive layer is irradiated, mobile charge carriers are generated which migrate to the surface of the element and there dissipate the surface charge. This leaves behind a charge pattern in nonirradiated areas, referred to as a latent electrostatic image. This latent electrostatic image can then be developed, either on the surface on which it is formed, or on another surface to which it has been transferred, by application of a liquid or dry developer composition which contains finely divided electroscopic marking particles. These particles are selectively attracted to and deposit in the charged areas or are repelled by the charged areas and selectively deposited in the uncharged areas. The pattern of marking particles can be fixed to the surface on which they are deposited or they can be transferred to another surface and fixed there.

Photoconductive elements can comprise a single active layer, containing the photoconductive material, or they can comprise multiple active layers. Elements with multiple active layers (sometimes referred to as multiactive elements) have at least one charge generating layer and at least one charge transport layer. The charge generating layer responds to actinic radiation by generating mobile charge carriers and the charge transport layer facilitates migration of the charge carriers to the surface of the element, where they dissipate the uniform electrostatic charge in light-struck areas and thus form the latent electrostatic image.

U.S. Pat. No. 3,904,407 to Regensberger et al discloses multilayer electrophotographic elements including a perylene pigment charge generating layer, a transport layer and a conductive support. Perylene pigments are formed as the condensation product of perylene tetracarboxylic acid and amines. They can conveniently be vacuum-deposited to form a charge generating layer with a high level of electrophotographic sensitivity. However, the thin binderless pigment layers disclosed by Regensberger are plagued by physical defects such as poor adhesion and cracking. More particularly, vacuum-deposited pigment layers are very fragile even as a very thin layer. When a pigment is vacuum-deposited directly on a conductive support such as nickel and overcoated with a charge transport layer, often the cohesive strength of the element is very poor and the layers readily peel off from the support.

It is well known that an interlayer can be used over the conductive support to improve adhesion between the conductive support and the overlying layers. Examples of such interlayers are set forth in commonly assigned U.S. Pat. Nos. 4,082,551 and 4,173,473. A number of interlayer materials have been tested and are either not effective in improving the physical properties of binderless perylene pigment layers or, if they improve the physical properties of the layer, they also decrease the sensitivity of the elements, which limits their utility in practical imaging systems.

According to the present invention, the above problems are solved by the use of an acrylonitrile copolymer interlayer between the conductive support and the pigment charge generating layer. Acrylonitrile copolymer interlayers have been found that not only exhibit acceptable adhesion and freedom from cracking defects but which unexpectedly increase the photosensitivity of the element. Preferably the interlayer has a glass transition temperature (Tg) of 35° C. or higher.

The photoconductive element of the invention comprises an electrically conducting support, a charge generating layer containing a photoconductive pigment such as a perylene dicarboximide pigment and an acrylonitrile copolymer interlayer disposed between the conductive support and the charge generating layer.

In photoconductive elements of the invention, a preferred charge generating layer contains a perylene dicarboximide pigment, and most preferably those of the formula:

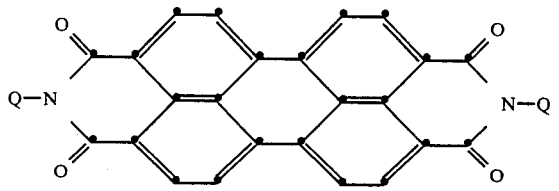

wherein Q represents alkyl, aryl, alkylaryl, aralkyl, alkoxy, halogen or heterocyclic substitutents. Examples include substituents wherein the alkyl and alkoxy groups have from 1 to 16 carbon atoms (preferably 1 to 8 carbon atoms) the aryl and aromatic portions of the alkylaryl and aralkyl groups have from 6 to 12 carbon atoms and the heterocyclic substituents have 4 or 5 carbon atoms and a hetero atom such as nitrogen, oxygen or sulfur.

The term, perylene dicarboximide pigment thus applies to a series of compounds having a structure which is prepared by reacting 3,4,9,10-perylene tetracarboxylic acid with amines, amides, or hydrazine compounds.

Such perylene pigments can be synthesized by conventional techniques. For example, 3,4,9,10-perylene tetracarboxylic acid can be reacted with primary amines of the formula $R\text{-}NH_2$, in a molar ratio of about 1:2, at elevated temperatures in the presence of acid condensation agents.

Other charge generating perylene pigments can also be used. Useful perylene pigments include those prepared by the reaction of 3,4,9,10-perylene tetracarboxylic acid with alkyl, aryl, and alkylaryl amines; alkyl, aryl, and alkylaryl amides; and alkyl, aryl and alkylaryl hydrazine compounds.

Perylene dicarboximide pigments which have an aryl or aralkyl group substituent and mixtures thereof, are preferred for use in electrophotographic elements as they are highly photosensitive as charge generating layers and are readily available. For example, the following pigments produce excellent results:

I.

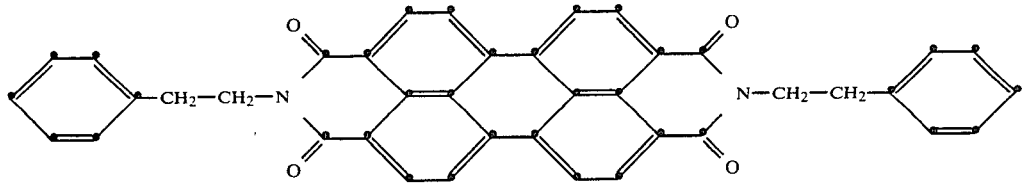

II.

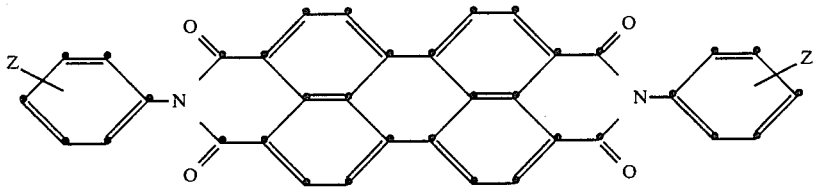

In compound II, Z is a chloro or methoxy group. These particular compounds are prepared by reacting 3,4,9,10-perylene tetracarboxylic acid with p, m, or o-chloroaniline and p, m, or o-methoxy-aniline.

Examples of other suitable perylene pigments are set forth in the above U.S. Pat. No. 3,904,407 to Regensberger.

Examples of other pigments which can be used in accordance with the invention in charge generating layers are perinones, azo pigments, indigo pigments such as Thiofast Red manufactured by Harmon Colors Company, and fused aromatic ring system pigments such as Indofast Yellow, and Indofast Orange pigments manufactured by Harmon Colors Company. For more complex disclosures of photoconductive pigments, reference may be made to the following: phthalocyanines, Eley, Nature, 1948, 162, 819 and Vartanian, Chemical Abstracts, 1949, 43, 1272 g and U.S. Pat. No. 3,397,086; indigo pigments, German DOS No. 3,108,968; perylene pigments, German DOS No. 2,108,992; also Canadian Pat. Nos. 834,086 and 835,884; British Pat. Nos. 1,175,452, 1,183,762 and 1,116,553; and U.S. Pat. Nos. 3,445,227, 3,448,030, 3,448,029, 3,447,922, 3,446,722, 3,448,028 and 3,448,038.

The charge transport layer can include a number of organic or inorganic materials, which are capable of transporting charge carriers generated in the charge generating layer. Most charge transport materials preferentially accept and transport either positive charges (holes) or negative charges (electrons), although there are amphoteric materials known which will transport both positive and negative charges. Transport materials which exhibit a preference for conduction of positive charge carriers are referred to as p-type transport materials whereas those which exhibit a preference for the conduction of negative charges are referred to as n-type.

P-type organic charge transport materials are particularly useful in the charge transport layer of the present invention. Any of a variety of organic photoconductive materials which are capable of transporting positive charge carriers can be employed. Representative p-type organic photoconductive materials are set forth in column 13 of U.S. Pat. No. 4,175,960 while representative n-type materials are set forth in column 14 of this patent.

A single charge transport layer can be employed or more than one can be employed. Where a single charge transport layer is employed it can be either a p-type or an n-type material.

In the preferred composition of the invention the charge generating layer is between an adhesive acrylonitrile copolymer interlayer on a conducting support and a single charge transport layer. Since there are a multiplicity of suitable charge transport materials this arrangement provides a great deal of flexibility and permits physical and surface characteristics of the element to be controlled by the nature of the charge transport layer selected.

Where it is intended that the charge generation layer be exposed to actinic radiation through the charge transport layer, it is preferred that the charge transport layer have little or no absorption in the region of the electromagnetic spectrum to which the charge generation layer responds, thus permitting the maximum amount of actinic radiation to reach the charge generation layer. Where the charge transport layer is not in the path of exposure, this consideration does not apply.

The charge generating layer, the charge transport layer, and the interlayer can be applied by vacuum deposition or by solvent coating. When solvent coating is employed to coat any or all of these layers a suitable film-forming polymeric binder can be employed. The binder can, if it is electrically insulating, help to provide the element with electrical insulating characteristics. It also serves as a film-forming material useful in (a) coating the layer, (b) adhering the layer to an adjacent layer, and (c) when it is a top layer, providing a smooth, easy to clean, and wear resistant surface.

Where a polymeric binder is employed in either the charge generating or charge transport layer, the optimum ratio of charge generation or charge transport material to binder can vary widely depending on the particular polymeric binder(s) and particular charge transport material(s) employed.

The charge generating and charge transport layers can also contain other addenda such as leveling agents, surfactants, plasticizers, and the like to enhance or improve various physical properties of the layer. In addition, various addenda to modify the electrophotographic response of the element can be incorporated in the charge transport layer. For example, various contrast control materials, such as certain hole-trapping agents and certain easily oxidized dyes can be incorporated in the charge transport layer. Various such contrast control materials are described in *Research Disclosure,* Vol. 122, June 1974, p. 33, in an article entitled "Additives For Contrast Control In Organic Photoconductor Compositions and Elements".

When the charge generating layer, the charge transport layer, or the interlayer is solvent coated, the components of the layer are dissolved or dispersed in a suitable liquid together with a binder, if one is employed. Useful liquids include aromatic hydrocarbons such as benzene, naphthalene, toluene, xylene and mesitylene; ketones such as acetone and butanone; halogenated hydrocarbons such as methylene chloride, chloroform and ethylene chloride; ethers including ethyl ether and cyclic ethers such as tetrahydrofuran; and mixtures of the above.

A variety of electrically conducting supports can be employed in the elements of this invention, such as for example, paper (at a relative humidity above 20 percent); aluminum-paper laminates; metal foils such as aluminum foil, zinc foil, etc.; metal plates such as aluminum, copper, zinc, brass and galvanized plates; vapor deposited metal layers such as silver, chromium, nickel, aluminum and the like coated on paper or conventional photographic film bases such as polyethylene terephthalate, cellulose acetate, polystyrene, etc. Such conducting materials as chromium or nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without electrical barrier layers are described in U.S. Pat. No. 3,245,833 by Trevoy, issued Apr. 12, 1966.

Optional overcoat layers can be used in the elements of the present invention, if desired. For example, to improve surface hardness and resistance to abrasion, the surface layer of the element of the invention can be coated with one or more electrically insulating, organic polymer coatings or electrically insulating, inorganic coatings. A number of such coatings are well known in the art and accordingly extended discussion thereof is unnecessary. Typical useful such overcoats are described for example, in *Research Disclosure,* "Electrophotographic Elements, Materials and Processes", Vol. 109, p. 63, Paragraph V, May 1973.

The photoconductive elements of this invention can be used in the ways and for the purposes that such elements are used in the art. While it is expected that they will find principal use as electrophotographic elements in the art of electrophotography, they can also be used in other arts, such as the solar cell art, where photoconductive elements are employed.

The following examples further illustrate the invention.

PREPARATIVE EXAMPLE 1

Preparation of Poly(Acrylonitrile-co-n butyl acrylate) (weight ratio 75/25)

In a three-necked one liter flask were charged 300 ml of distilled water and 1.5 g of Triton 770 (30%) (Triton 770 is the trademark for a surfactant obtainable from Rohm and Haas Company), and the content was stirred at 70° C. under nitrogen atmosphere. In an additional funnel, which was attached to the flask, were added 75 g of acrylonitrile and 25 g of butyl acrylate. Polymerization was initiated by adding 1 g of $K_2S_2O_5$ followed by the addition of monomers over a period of 30 min. The polymerization was allowed to continue for an additional 2 hr at 70° C. It was then cooled to room temperature and dialyzed against water for 3 hr. The total solid was found to be 23.3%.

PREPARATIVE EXAMPLE 2

Preparation of Poly(Acrylonitrile-co-vinylidene chloride-co-acrylic acid) (weight ratio 14.1/79.9/6)

| Reactants | Weight |
|---|---|
| Acrylonitrile | 7.54 g |
| Vinylidene chloride | 42.59 g |
| Triton 770 (as 30% sol'n) | 4.17 g |
| $Na_2S_2O_5$ | 0.12 g |
| $K_2S_2O_8$ | 0.25 g |
| Dist $H_2O$ | 200.0 ml |

Apparatus

A 400 ml pressure bottle tumbled in a constant temperature bath comprised the polymerization apparatus.

Procedure

1. A stock solution of Triton 770, $Na_2S_2O_5$ and 100 ml distilled $H_2O$ was made and stirred under $N_2$; similarly, a second stock solution of $K_2S_2O_8$ in 100 ml distilled $H_2O$ was made and stirred under $N_2$.
2. Pressure bottle was flushed with $N_2$, then both monomers were added in a hood.
3. The solution containing Triton and $Na_2S_2O_5$ was added to the bottle and the contents swirled to form an emulsion.
4. $K_2S_2O_8$ in water was added, and the bottle immediately capped with a Teflon lined bottle top, and put in bucket of ice water.
5. The cooled bottle was shaken, then put in bottle tumbler in a constant-temperature bath set at 37°–40° C.
6. After forty hours, the bottle was removed from the bath, cooled, and opened in hood to vent any monomer vapors.
7. The product latex, having a warm color with a blue hue (indicating small particle size) was filtered at atmospheric pressure, through Reeve Angel 230 filter paper. Filtration was quick and easy, with very little coagulum appearing on the filter paper.
8. The crude latex, after filtration, had 20.05% solids, which is 98.7% of theoretical yield.
9. The latex was dialyzed against distilled $H_2O$ for 66 hours.
10. The polymer was isolated from the dialyzed latex by freeze drying. It was found to have an inherent viscosity (in THF) of 0.63, with a glass transition temperature of 35° C.

In the following working examples, Example 1 is a control which sets forth a method of producing an element without an interlayer and Example 2 is a control wherein a polyester interlayer is employed.

WORKING EXAMPLES

EXAMPLE 1 (Control)

A multiactive electrophotographic element was prepared as follows: A $2000\times10^{-10}$ m thick layer of N,N'-bis(2-phenethyl)perylene-3,4',9,10-bis(dicarboximide)

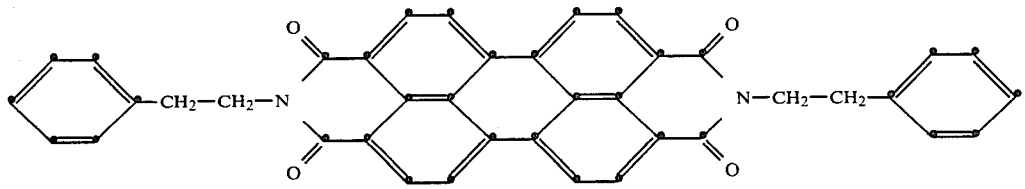

was vacuum-deposited over a nickel electrode to form the charge-generating layer. The charge transport layer (CTL) was then formed by overcoating the charge transport generation layer with bisphenol A polycarbonate and tri-p-tolylamine (60:40 weight ratio) in dichloromethane, the dry thickness of the layer being 11 μm. The film was oven dried for one hour at 60° C. The electrophotographic test data for this sample are included in Table A below.

EXAMPLE 2 (Control)

A multiactive element was prepared in a manner similar to that described in Example 1 except that before vacuum-deposition of pigment I, an interlayer coating of poly(ethylene-co-neopentylene terephthalate) 55/45 disclosed in U.S. Pat. No. 4,173,472 in dichloromethane was coated over the nickel electrode at a coverage of $1.3910^{-2}$ mg/cm$^2$ (0.013 g/ft$^2$) and dried.

EXAMPLE 3

An element was prepared similar to that described in Example 2 except that the interlayer coating was made with [poly(acrylonitrile-co-n-butyl acrylate)(weight ratio 75/25)] using a 0.001" coating blade. Surfactant 10G, a surface-active agent sold by Olin Chem. Co., was added to the latex, prior to coating, at a concentration of 0.023%. The final coating was oven dried for one hour at 60° C.

EXAMPLE 4

An element was prepared substantially as in Example 2 except that [poly(acrylonitrile-co-vinylidene chloride (weight ratio 15/85)] was used as the interlayer. The interlayer was coated from a 15% solids solution in methyl ethyl ketone to a dry coverage of $7.535\times10^{-3}$ mg/cm$^2$ (7 mg/ft$^2$).

EXAMPLE 5

An element was prepared substantially as in Example 2 except that poly(acrylonitrile-co-vinylidene chloride-co-acrylic acid) (weight ratio 14.1/79.9/6) was used as the interlayer. The interlayer was coated from a 1% solids latex.

TABLE A

| Exam. No. | Rel. Expos. 500–100V in joules/m$^2$ × $10^{-3}$ @ 630 nm | Cracks in Charge Generating Layer | Adhesion |
|---|---|---|---|
| 1 | 1.00* | No | Poor |
| 2 | 2.37 | Yes | Excellent |
| 3 | 1.61 | No | Good |
| 4 | 0.97 | No | Excellent |
| 5 | 1.08 | No | Excellent |

*Arbitrarily assigned a value of 1.00 for ease of comparison.

The above data illustrate the overall superiority of acrylonitrile copolymer interlayers relative to a typical control polyester interlayer for this application.

In the following examples, 6 (Control) and 7 a non-perylene pigment is vacuum-deposited as the charge generating layer.

EXAMPLE 6 (Control)

A multiactive electrophotographic element was prepared as follows on a vacuum-deposited nickel electrode substrate. Over the conductive substrate was coated a polyester interlayer as in Example 2, over which was vacuum-deposited a $2.0\times10^{-4}$ m (2000 A) layer of Thiofast Red pigment, a 6,6'-dichloro-2,2'-bisthionaphthene indigo pigment manufactured by Harmon Colors Company. Finally, a CTL was solvent coated thereover. The CTL was an 11 μm layer comprising 60% poly[4,4'-(2-norbornylidene)diphenylene azelate-co-terephthalate(40/60)], and 40% tri-p-tolylamine. See U.S. Pat. Nos. 3,517,071 and 3,703,372.

EXAMPLE 7

An element was prepared similar to that described in Example 6 except that the interlayer of Example 3 was substituted for the polyester interlayer used in Example 6.

The test results obtained for Examples 6 and 7 are listed in Table B below.

TABLE B

| Exam. No. | Rel. Exp. 500–100V in joules/m$^2$ × $10^{-3}$ @ 630 nm | Pigment Emitter Cracks | Layer Adhesion |
|---|---|---|---|
| 6 | 1.00* | Yes | Excellent |
| 7 | 0.30 | No | Good |

*Arbitrarily assigned a value of 1.00 for ease of comparison.

The unexpected increase in speed produced by acrylonitrile-copolymer interlayers is readily seen in Table B.

Further experiments were conducted in the manner of Examples 6 and 7 comparing the utility of a number of different interlayers with the Thiofast Red emitter layer. Improved sensitivity, relative to Example 6 (Control) was observed with acrylonitrile copolymers.

With the same pigment used in Example 6, the following acrylonitrile copolymers were used: poly(acrylonitrile-co-n-butyl acrylate), poly(methylacrylate-co-acrylonitrile), poly(acrylonitrile-co-methylacrylate) and poly(acrylonitrile-co-ethylacrylate). All of these copolymers improved the sensitivity. However, they did not improve adhesion of the element as well as Example 6.

EXAMPLE 8 (Comparative 1)

A polyester interlayer of poly(2,2-dimethyl-1,3-propylene-co-ethylene terephthalate), was applied over a nickel electrode prior to vacuum-deposition of the pigment, the element exhibited good adhesion of the layers but the pigment layer tended to crack or become severely distorted upon application of the charge transport layer. This can be caused by solvent attack of the polyester interlayer by diffusion of the chlorinated solvents used to coat the charge transport layer.

This invention has been described in detail with certain preferred embodiments thereof. It will be understood that variations and modification can be effected within the scope of the invention. The interlayers of this invention could also be used with other charge generating layers made from pigments such as phthalocyanine derivatives or perinone derivatives.

The charge generating layers employed in the above examples were deposited at approximately $2.0\times10^{-7}$ m thickness. The interlayers of this invention or mixtures thereof can also be used with charge generation layers deposited at various other thicknesses, especially in the range of $1.0\times10^{-6}$ m or more, thus resulting in elements with even higher sensitivities. The elements can be toned to form visible images by the use of dry or liquid electrographic developers known in the art and the elements may be utilized in a reuse mode or in a single-use mode. The elements can be coated on a variety of transparent or opaque conductive supports also known to those skilled in the art.

What is claimed is:

1. In a photoconductive element comprising an electrically conductive support, a charge generating layer containing a photoconductive pigment, a charge transport layer, and an interlayer between the conductive support and the charge generating layer, the improvement wherein the interlayer comprises an acrylonitrile copolymer.

2. A photoconductive element comprising the following layers, in order:

(a) an electrically conducting layer;

(b) an acrylonitrile copolymer interlayer;

(c) a charge generation layer containing a pigment; and (d) a charge transport layer.

3. The element as set forth in claim 2 wherein the polymeric interlayer has a Tg of 35° C. or higher and is a copolymer of acrylonitrile with a comonomer selected from the group consisting of n-butylacrylate, vinylidene chloride, and acrylic acid.

4. The element as set forth in claim 3 wherein the pigment of said charge generating layer is a compound of the formula:

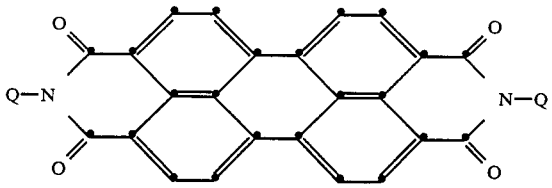

wherein Q represents alkyl, aryl, alkylaryl, aralkyl, alkoxy, halogen or heterocyclic substituents.

5. The element as set forth in claim 2, wherein said pigment is selected from the group consisting of perylene dicarboximides, perinones, azo pigments, indigo pigments and fused aromatic ring system pigments.

6. A photoconductive element comprising an electrically conductive support, a charge generation layer comprising a vacuum-deposited photoconductive pigment, and a charge transport layer; said element having an acrylonitrile copolymer interlayer between said support and said charge generation layer.

7. A photoconductive element comprising an electrically conductive support, a charge generation layer comprising a vacuum-deposited perylene pigment, and a charge transport layer; said element having an acrylonitrile copolymer interlayer between said support and said charge generation layer.

8. A photoconductive element comprising an electrically conductive support, a charge generation layer comprising a vacuum-deposited phthalocyanine pigment, and a charge transport layer; said element having an acrylonitrile copolymer interlayer between said support and said charge generation layer.

9. A photoconductive element comprising an electrically conductive support, a charge generation layer comprising vacuum-deposited N,N'-bis(2-phenethyl)-perylene-3-4:9,10-bis(dicarboximide), and a charge transport layer; said element having an acrylonitrile copolymer interlayer between said support and said charge generation layer.

10. A photoconductive element comprising an electrically conductive support, a charge generation layer comprising vacuum-deposited N,N'-bis(2-phenethyl)-perylene-3,4:9,10-bis(dicarboximide), and a charge transport layer comprising tri-p-tolylamine; said element having an interlayer of poly(acrylonitrile-co-vinylidene chloride) between said support and said charge generation layer.

11. A process for preparing a photoconductive element, which process comprises the steps of:

(1) coating on an electrically conductive support an interlayer comprising an acrylonitrile copolymer, (2) depositing on said interlayer a binderless layer of photoconductive pigment to thereby form a charge generation layer, and (3) applying over said binderless layer of photoconductive pigment a coating composition containing a charge transport agent to thereby form a charge transport layer.

12. A process as claimed in claim 11 wherein said binderless layer is formed by vacuum-deposition.

13. A process as claimed in claim 11 wherein said photoconductive pigment is a perylene pigment.

14. A process as claimed in claim 11 wherein said photoconductive pigment is N,N'-bis(2-phenethyl)perylene-3,4:9,10-bis(dicarboximide).

15. A process as claimed in claim 11 wherein said coating composition which forms a charge transport layer comprises an organic solvent, a polymeric binder, and a charge transport agent.

16. A process for preparing a photoconductive element, which process comprises the steps of:

(1) coating on an electrically conductive support an inerlayer comprising poly(acrylonitrile-co-vinylidene chloride), (2) vacuum depositing on said interlayer a binderless layer of N,N'-bis(2-phenethyl)perylene-3,4:9,10-bis(dicarboximide) to thereby form a charge generation layer, and (3) applying over said binderless layer a coating composition containing an organic solvent, a polymeric binder, and tri-p-tolylamine to form thereon a charge transport layer.

17. A photoconductive element produced by the process of claim 11.

18. A photoconductive element produced by the process of claim 16.

* * * * *